US007140210B2

(12) United States Patent
Cheng

(10) Patent No.: US 7,140,210 B2
(45) Date of Patent: Nov. 28, 2006

(54) LOCK

(75) Inventor: Ming-Hsin Cheng, Taichung (TW)

(73) Assignee: Chern Hung Industry Co., Ltd., Taichung (TW)

( * ) Notice: Subject to any disclaimer, the term of this patent is extended or adjusted under 35 U.S.C. 154(b) by 0 days.

(21) Appl. No.: 10/945,494

(22) Filed: Sep. 21, 2004

(65) Prior Publication Data

US 2006/0027002 A1 Feb. 9, 2006

(51) Int. Cl.
*E05B 69/00* (2006.01)

(52) U.S. Cl. ..... 70/58; 70/14; 70/30

(58) Field of Classification Search ..... 70/14, 70/57, 58, 30, 49

See application file for complete search history.

(56) References Cited

U.S. PATENT DOCUMENTS

| | | | | |
|---|---|---|---|---|
| 5,381,685 | A * | 1/1995 | Carl et al. | 70/58 |
| 5,913,907 | A * | 6/1999 | Lee | 70/58 |
| 6,058,744 | A * | 5/2000 | Ling | 70/28 |
| 6,199,413 | B1 * | 3/2001 | McDaid et al. | 70/58 |
| 6,205,824 | B1 * | 3/2001 | Miao | 70/58 |
| 6,244,080 | B1 * | 6/2001 | Sakurai | 70/14 |
| 6,257,029 | B1 * | 7/2001 | Liao | 70/58 |
| 6,389,853 | B1 * | 5/2002 | Pate et al. | 70/18 |
| 6,401,502 | B1 * | 6/2002 | Yang | 70/30 |
| 6,449,992 | B1 * | 9/2002 | Yu et al. | 70/58 |
| 6,463,770 | B1 * | 10/2002 | Lee | 70/58 |
| 6,523,373 | B1 * | 2/2003 | Su | 70/58 |
| 6,536,244 | B1 * | 3/2003 | Chang | 70/58 |
| 6,588,241 | B1 * | 7/2003 | Murray et al. | 70/58 |
| 6,619,080 | B1 * | 9/2003 | Yu | 70/58 |
| 6,619,081 | B1 * | 9/2003 | Yu | 70/58 |
| 6,672,117 | B1 * | 1/2004 | Yu | 70/58 |
| 2004/0035158 | A1 * | 2/2004 | Chang | 70/58 |

* cited by examiner

*Primary Examiner*—Suzanne Dino Barrett
(74) *Attorney, Agent, or Firm*—Browdy and Neimark, PLLC

(57) ABSTRACT

A lock has a housing with a hole. A lock post has an interior end fixed in the housing and an exterior end extruded out of the housing via the hole. The lock post has a lock portion at the exterior end thereof. Two close posts have interior ends received in the housing and a plate is connected to the interior ends. The close posts are movable relative to the lock post. A control device is provided to the housing for manipulation to move the close posts. An elastic device is provided in the housing with opposite ends against the housing and the plate. A lock mechanism is provided to the housing to be switched between an unlock condition, in which the close posts are free for movement, and a lock condition, in which the close posts are exterior ends thereof extruded out of the housing and are secured threat.

4 Claims, 7 Drawing Sheets

LOCK

BACKGROUND OF THE INVENTION

1. Field of the Invention

The present invention relates generally to a lock, and more particularly to a lock having an easier way in use.

2. Description of the Related Art

FIG. 13 shows a conventional lock 90, which has a housing 91 with two lock posts 92, a ring 93 fitted to the housing 91 and a lock block 94 provided at between the lock posts 92 and connected to the ring 93. As shown in FIG. 14 and FIG. 15, while the lock 90 is unlocked, the ring 93 is rotated to drive the lock block 94 for rotation between an open position as shown in FIG. 13 and a close position as shown in FIG. 15.

Aforesaid lock usually is applied to notebook or hard disk and so on. The lock block is inserted into a lock hole of the notebook or hard disk and is locked therein. This kind of lock is locked by rotating the ring to drive the lock block turning and locked in the lock hole.

In application, a cable is connected to the lock and the cable has a loop at a distal end thereof. As shown in FIG. 16, the cable 95 is wound on a fixed device, such as a column, and the lock passes through the loop 96 and is locked with the notebook to lock the notebook to the column.

Another application is that the cable has a fixed block 97 with a hole to be fitted to the cable and moved to where beside the loop. The cable is wound on the predetermined object, it is a suitcase in FIG. 17, and lock it on the column.

SUMMARY OF THE INVENTION

The primary objective of the present invention is to provide a lock, which has an easier way for operation.

According to the objective of the present invention, a lock comprises a housing having a hole at an end thereof. A lock post has an interior end fixed in the housing and an exterior end extruded out of the housing via the hole. The lock post has a lock portion at the exterior end thereof. Two close posts have interior ends received in the housing and a plate is connected to the interior ends of the posts. The close posts are manipulative for movement relative to the lock post to move exterior ends of the close posts extruded out of the housing via the hole and received in the housing. The lock post is located between the close posts and the close posts are arranged at opposite sides of a narrow orientation of the hook portion. A control device is provided to the housing for manipulation to move the close posts. An elastic device is provided in the housing with opposite ends against the housing and the plate to be adapted to move the close posts outwardly. A lock mechanism is provided to the housing to be switched between an unlock condition, in which the close posts are free for movement relative to the lock post via manipulation of the control device, and a lock condition, in which the close posts are exterior ends thereof extruded out of the housing and secured thereat. A cable is fastened to the housing and having a loop at a distal end thereof.

DETAILED DESCRIPTION OF THE INVENTION

Figure 1:
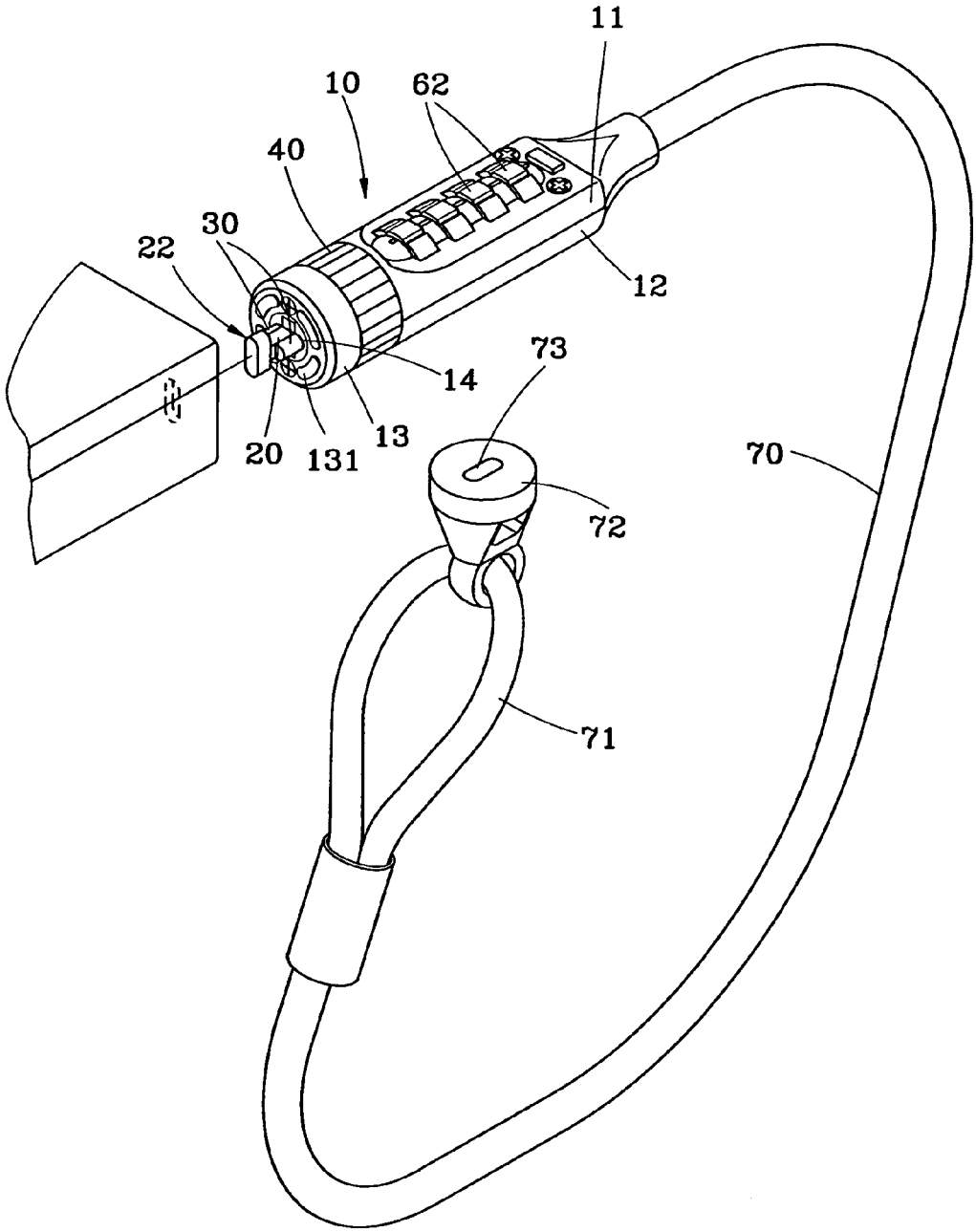
FIG. 1 is a perspective view of a first preferred embodiment of the present invention.
Figure 2:
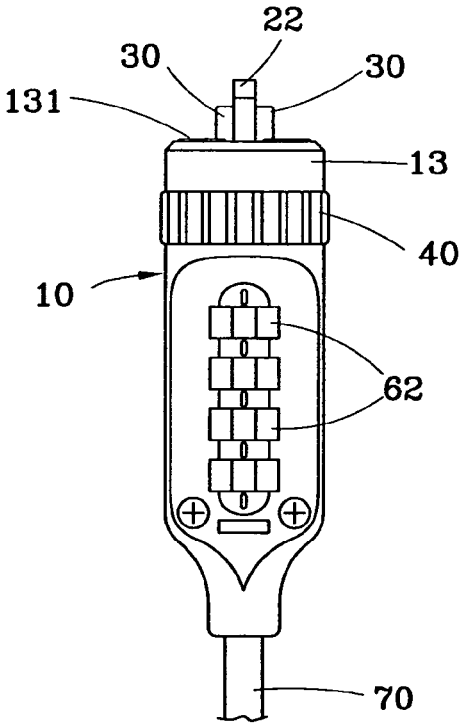
FIG. 2 is a front view of the first preferred embodiment of the present invention.
Figure 3:
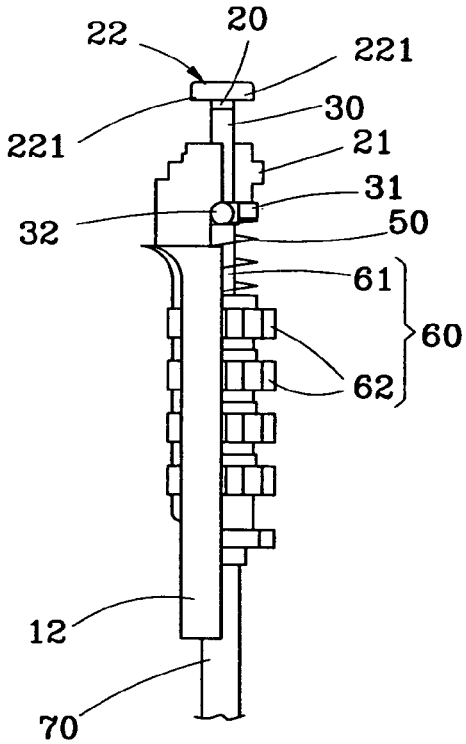
FIG. 3 is a lateral view of the first preferred embodiment of the present invention.

As shown in FIGS. from FIG. 1 to FIG. 6, a lock 10 of the first preferred embodiment of the present invention comprises:

A housing 10, as shown in FIG. 1 and FIG. 2, is consisted of an upper housing 11 and a lower housing 12. An edge ring 13 is fitted to the housing 10 at a front end thereof, which has a plurality of soft pads 131 at an outer surface thereof and an elongated hole 14 at a middle thereof.

A lock post 20, as shown in FIG. 1 to FIG. 4, has two protrusions 21 at a bottom side thereof to secure the lock post 20 in the housing 10. An end of the lock post 20 passes through the hole 14 of the edge ring 13 to be extruded out of the housing 10 and has a hook portion 22. In the present preferred embodiment, the hook portion 22 has two protrusions 221, which are perpendicular to an elongated axis of the lock post 20.

Two close posts 30, as shown FIG. 1 to FIG. 4, have ends passing through the hole 14 to be extruded out of the housing 10 and the lock post 20 is located at between the close posts 30. The close posts 30 are located at opposite sides of a narrow orientation of the hook portion 22. A plate 31 is located in the housing 10 and is connected to interior ends of the close posts 30, which has two guide shafts 32 at opposite sides thereof. The close posts 30 are moved relative to the lock post 20 to be extruded out of the housing 10 and received in the housing 10.

Figure 4:
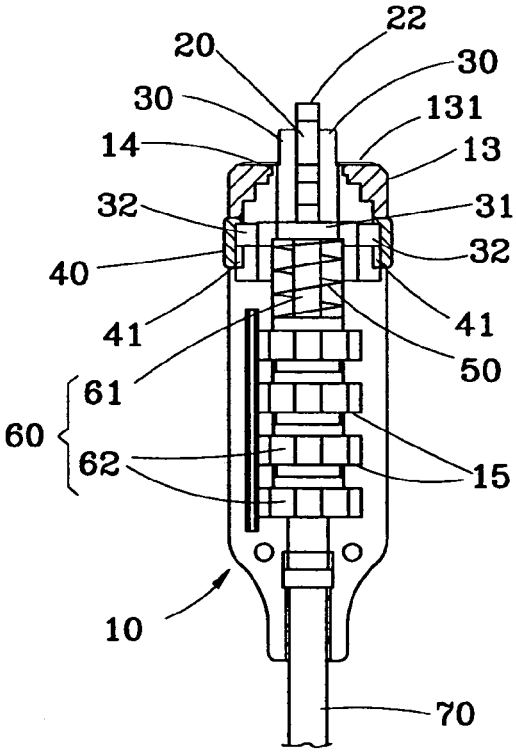
FIG. 4 is a sectional view of the first preferred embodiment of the present invention in the lock condition.
Figure 5:
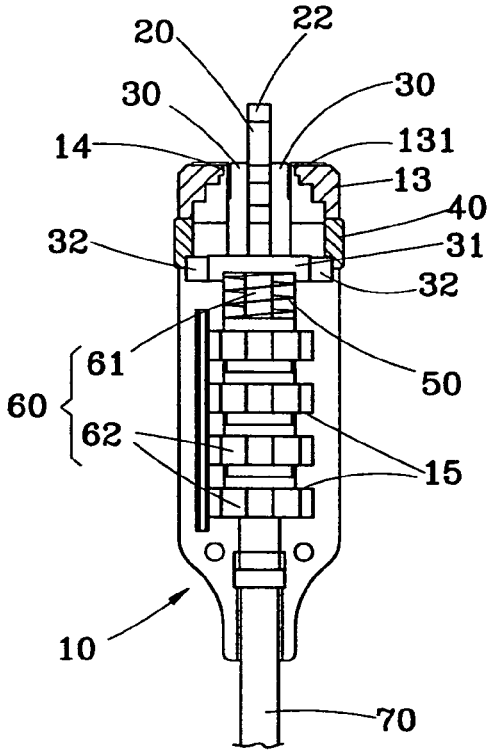
FIG. 5 is a sectional view of the first preferred embodiment of the present invention in the unlock condition.
Figure 6:
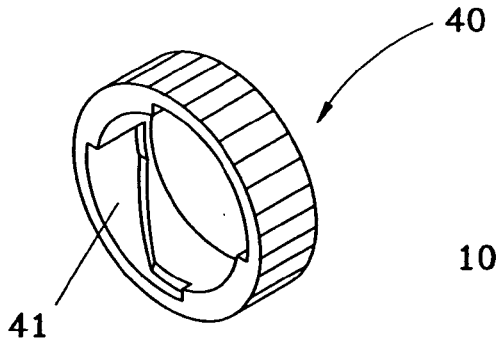
FIG. 6 is a perspective view of the rotary ring the first preferred embodiment of the present invention.

A control device 40 is provided to drive the close posts 30 for movement. As shown in FIG. 1 to FIG. 6, the control device 40 is a rotary ring in the present preferred embodiment to be fitted to the housing 10 behind the edge ring 13. The rotary ring 40 has two spiral slots 41 at an interior side thereof. The guide shafts 32 of the plate 31 are received in the slots 41 of the rotary ring 40 respectively. As shown in FIG. 4 and FIG. 5, while the rotary ring 40 is turned, the guide shafts 32 are moved along the slots 41 to drive the close posts 30 moving out of or into the housing 10.

An elastic device 50 is provided in the housing 10 and has opposite ends thereof biasing the plate 31 and the housing 10 to force the control device 40 in a direction of moving out of the housing 10.

A lock mechanism 60, as shown in FIG. 1 to FIG. 5, is provided in the housing 10, which has a core 61, number wheels 62 fitted to the core 61. The upper and the lower housings 11 and 12 are provided with slots 15 on an interior side thereof to receive the number wheels 62 therein respectively and have a hole to expose portions of the number wheels 62. The core 61 is fixed to the plate 31, such that turning the number wheels 62 can switch the lock mechanism 60 between a lock condition and an unlock condition. As shown in FIG. 5, while the number wheels 62 are turned to a predetermined combination to switch the lock mechanism to the unlock condition, the core 61 is movable relative to the number wheels 62 and the rotary ring 40 is turned to move the close posts 30 out of or into the housing 10. As shown FIG. 4, while the lock mechanism is switched to the unlock condition, the core 61 is fixed without any movement, so that the close posts 30 is kept out of the housing 10 beside the lock post 20.

A cable 70, as shown in FIG. 1, has an end fastened to a bottom of the housing 10 and has a loop 71 at a distal end thereof. In the present preferred embodiment, a block 72 is mounted on the cable 70 at the section of the loop 71. The block 72 has a hole 73 like the conventional device.

Figure 7:
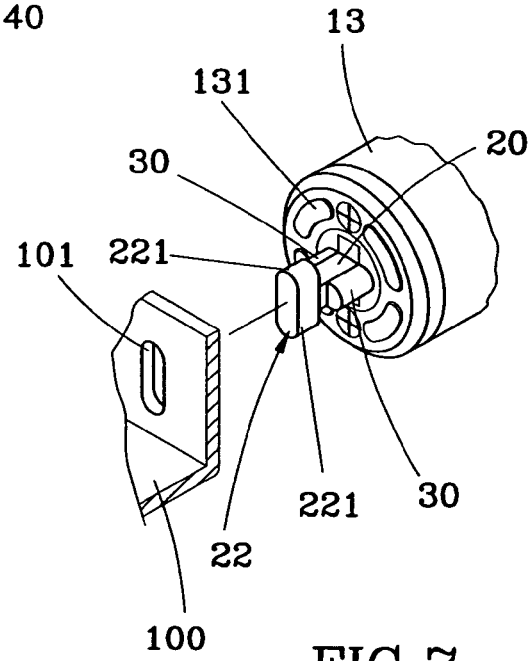
FIG. 7, FIG. 8 and FIG. 9 show the lock of the first preferred embodiment of the present invention in the unlock condition in application.
Figure 8:
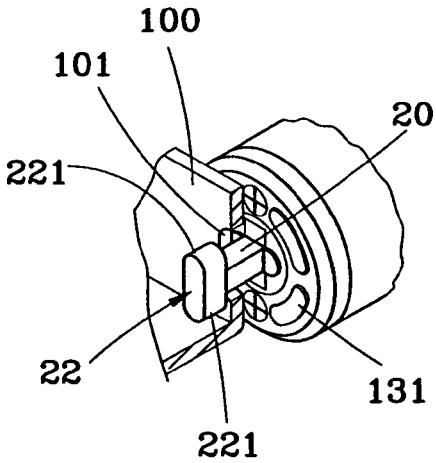
Figure 9:
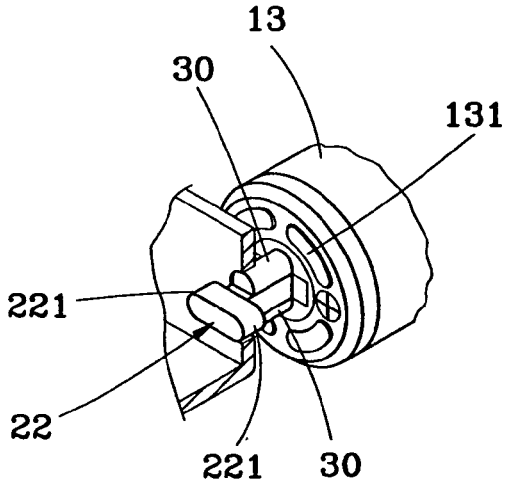

As shown in FIG. 7 to FIG. 9, in use od the lock of the present invention, the lock mechanism 60 is switched to the unlock condition, as shown in FIG. 7 and FIG. 8, and the lock post 20 is inserted into a lock hole 101 of a predetermined object 100. The close posts 30 are blocked by the object 100 and moved into the housing 10 while the lock post 20 is inserted into a lock hole 101. The pad 131 provides a buffering capacity between the housing 10 of the lock and the object 100. As shown in FIG. 9, the hook portion 22 is turned about 90 degrees to lock the lock post 20 in the lock hole 101. In the meantime, the close posts 30 are pushed by the elastic device 50 to be moved into the lock hole 101, and then the lock mechanism 60 is switched to the lock condition to secure the lock post 20. As a result, the object 100 is locked by the lock of the present invention. To unlock the lock of the present invention, the lock mechanism 60 is switched to the unlock condition and the control device 40 is manipulative to move the close posts 30 into the housing 10, and then the housing 10 is turned to turn the hook portion 22 about 90 degrees to permit the lock post 20 to be withdrawn out of the lock hole 101 of the object 100.

Figure 10:
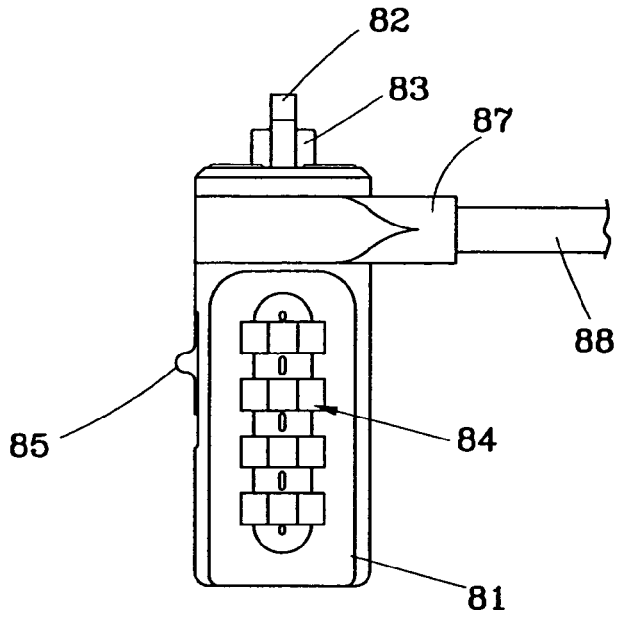
FIG. 10 is a front view of a second preferred embodiment of the present invention.
Figure 11:
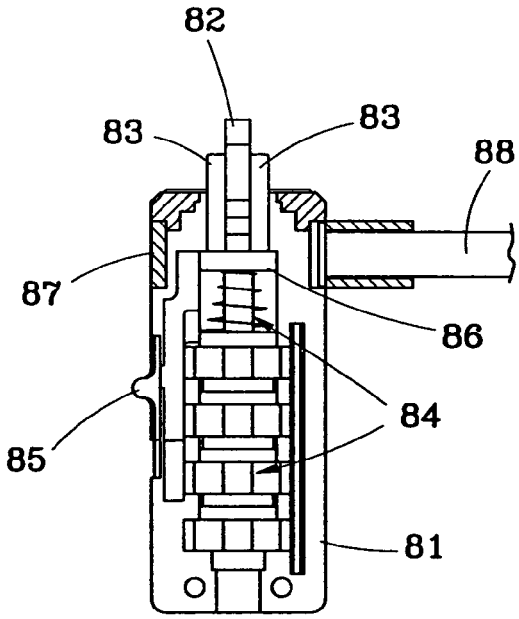
FIG. 11 is a sectional view of the second preferred embodiment of the present invention in the lock condition.
Figure 12:
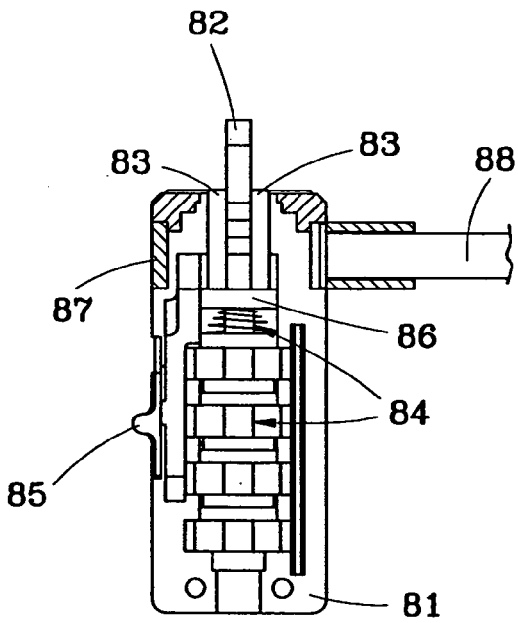
FIG. 12 is a sectional view of the second preferred embodiment of the present invention in the unlock condition.
Figure 13:
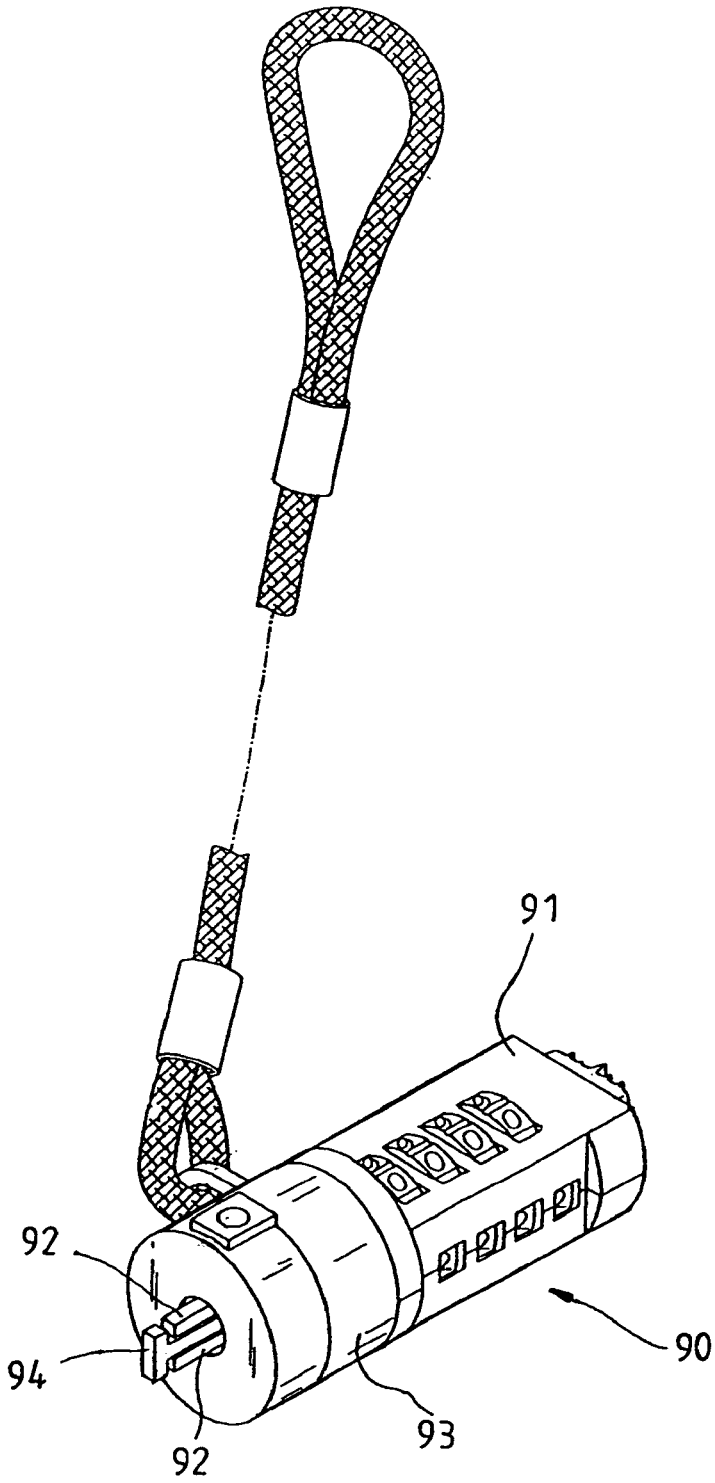
FIG.13 PRIOR ART
FIG. 13, FIG. 14, FIG. 15, FIG. 16 and FIG. 17 shows a prior art lock and its use in different situations.
Figure 14:
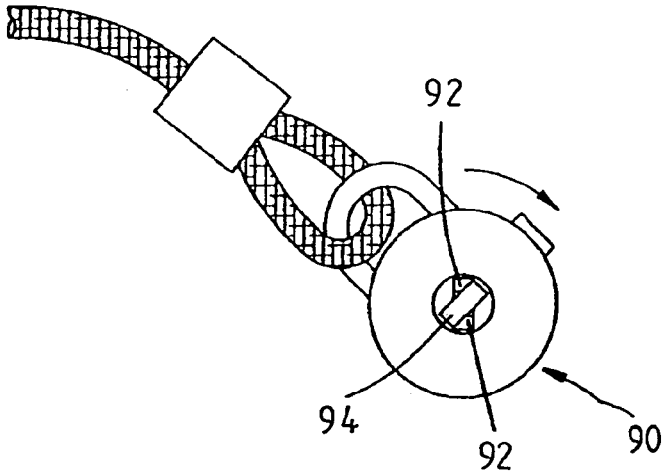
FIG.14 PRIOR ART
Figure 15:
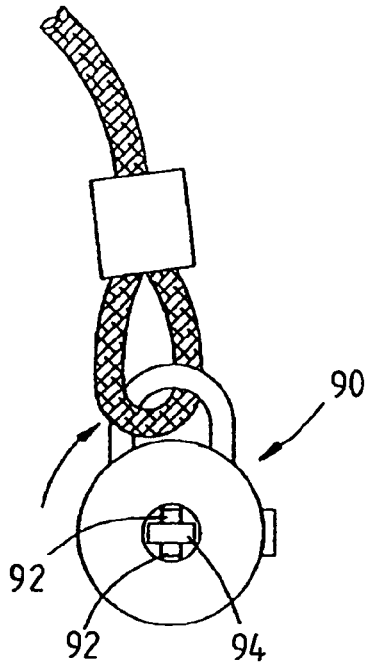
FIG.15 PRIOR ART
Figure 16:
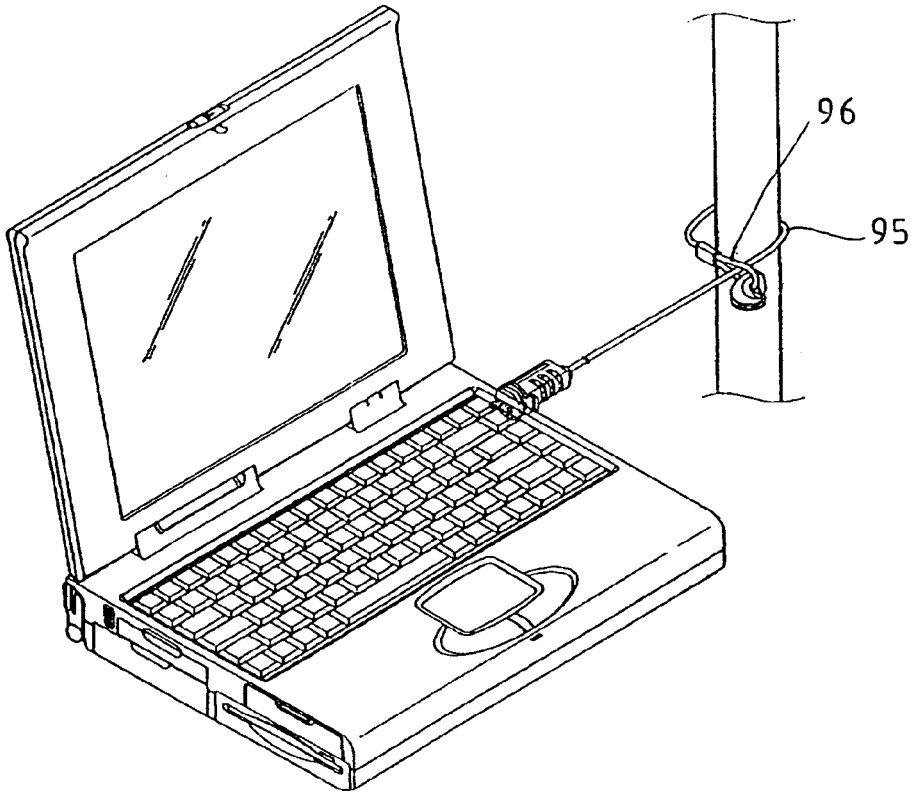
FIG.16 PRIOR ART
Figure 17:
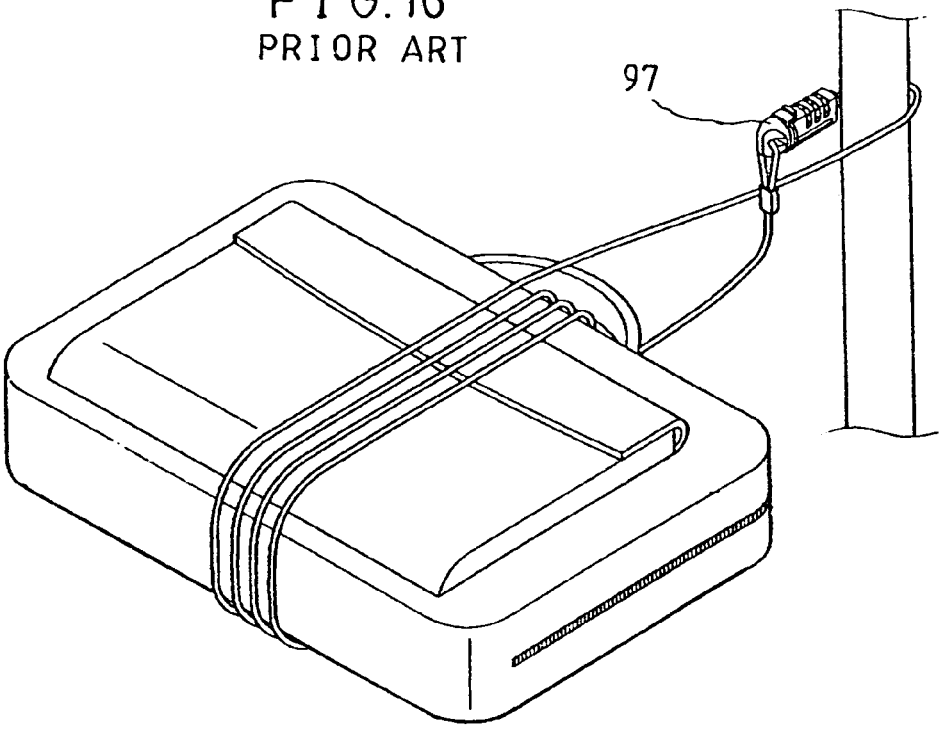
FIG.17 PRIOR ART

As shown in FIGS. 10–12, a lock of the second preferred embodiment of the present invention comprises a housing 81, a lock post 82, two close posts 83, a lock mechanism 84 and a control device 85. The control device 85 is a movable switch in the present preferred embodiment to be connected to a plate 86 at bottom ends of the close posts 83. As shown in FIG. 11 and FIG. 12, the switch 85 slidable so as to permit the close posts 83 to be moved out of or into the housing 81. A ring 87 is fitted to the housing 81 and a cable 88 is fixed to the ring 87. The ring 87 is rotary freely relative to the housing 81.

What is claimed is:

1. A lock, comprising:

a housing having a hole at an end thereof;

a lock post having a first end fixed within the housing and a second end extending out through the hole;

wherein the lock post has a retaining bar with planar sides at the second end thereof transverse to the axis of the lock post;

two close posts having respective first ends fixed to a plate slidably engaged in the housing and second ends extending out of the through hole along opposite sides of the lock post which are respectively coplanar with corresponding opposite sides of the retaining bar;

an annular control device rotatably engaged on the housing and having two spiral slots on an inside wall thereof, wherein said plate has two protrusions respectively engaged in said two spiral slots, wherein rotation of the control device moves the plate in the housing;

an elastic device in the housing having opposite ends engaged between the housing and the plate to bias the plate and the close posts outward;

a lock mechanism in the housing engaged to the plate to hold the close posts in a fully extended position outside the housing when locked and permit the plate and close posts to be drawn into the housing from the fully extended position by the annular control device when unlocked;

a cable fastened to the housing and having a loop of a distal end thereof.

2. The lock as defined in claim 1, wherein the lock mechanism has a core connected to the plate and plural number wheels fitted to the core and the housing has plural slots to receive the number wheels therein and a hole to expose portions of the number wheels out of the housing whereby the number wheels are turned to a predetermined combination to switch the lock mechanism to the unlock condition; while the lock mechanism is switched to the unlock condition, the core is free for movement relative to the number wheels to move the close posts and while the lock mechanism is switched to the lock condition, the core is fixed to secure the close posts.

3. The lock as defined in claim 1, wherein the cable is mounted with a block with a hole and the block is fitted to the cable at a section of the loop.

4. The lock as defined in claim 1, wherein the housing is fitted with an edge ring and the edge ring has a hole, in which the lock post and the close posts pass therethrough.

* * * * *